US008641139B2

(12) United States Patent
Gerken et al.

(10) Patent No.: US 8,641,139 B2
(45) Date of Patent: Feb. 4, 2014

(54) FLEXIBLE FLAT HEATING ELEMENT

(75) Inventors: Andreas Gerken, Hannover (DE); Juergen Buehring, Wedemark (DE); Roland Freudenmann, Wedemark (DE); Dorthe Wittje, Lingen (DE)

(73) Assignee: Benecke-Kaliko AG, Hannover (DE)

( * ) Notice: Subject to any disclaimer, the term of this patent is extended or adjusted under 35 U.S.C. 154(b) by 32 days.

(21) Appl. No.: 13/355,714

(22) Filed: Jan. 23, 2012

(65) Prior Publication Data

US 2012/0153688 A1 Jun. 21, 2012

Related U.S. Application Data

(63) Continuation of application No. PCT/EP2010/058213, filed on Jun. 11, 2010.

(30) Foreign Application Priority Data

Jul. 21, 2009 (DE) ..... 10 2009 026 216

(51) Int. Cl.
*A47C 7/74* (2006.01)

(52) U.S. Cl.
USPC ..... 297/180.12; 297/217.3; 219/202

(58) Field of Classification Search
USPC ..... 297/180.12, 217.3; 219/202
See application file for complete search history.

(56) References Cited

U.S. PATENT DOCUMENTS

| | | | | |
|---|---|---|---|---|
| 2,844,695 | A | 7/1958 | McLean | |
| 2,961,522 | A | 11/1960 | Hammer | |
| 8,201,880 | B2 * | 6/2012 | Kato et al. | 297/180.12 |
| 2010/0206863 | A1 | 8/2010 | Ritter | |

FOREIGN PATENT DOCUMENTS

DE 10 2007 042 644 A1 3/2009

OTHER PUBLICATIONS

International Search Report of PCT/EP2010/058213, Dated Sep. 21, 2010.

* cited by examiner

*Primary Examiner* — Anthony D Barfield
(74) *Attorney, Agent, or Firm* — Laurence A. Greenberg; Werner H. Stemer; Ralph E. Locher

(57) ABSTRACT

A flexible flat structure has a flexible, flat resistance heating element that is connected to electrodes that are spaced apart from one another for supplying electrical current that is pressed on to the resistance heating element by staples or clamps in a force-fit manner and/or a form-fit manner and provides a more flexible connection.

19 Claims, 4 Drawing Sheets

FLEXIBLE FLAT HEATING ELEMENT

CROSS-REFERENCE TO RELATED APPLICATION

This is a continuation application, under 35 U.S.C. §120, of copending international application No. PCT/EP2010/058213, filed Jun. 11, 2010, which designated the United States; this application also claims the priority, under 35 U.S.C. §119, of German patent application No. DE 10 2009 026 216.4, filed Jul. 21, 2009; the prior applications are herewith incorporated by reference in their entirety.

BACKGROUND OF THE INVENTION

Field of the Invention

The invention relates to a heatable, flexible flat structure, which has a flexible, flat resistance heating element of electrically conductive material and at least two possibly likewise flat electrodes, which are connected to the resistance heating element, are spaced apart from one another and are intended for feeding electric current into the resistance heating element.

Flat structures with electrically conductive flat elements are known and, where they are connected to electrodes and can be supplied with current, are mainly used as heating elements. Other applications in connection with flat, conductive elements for other functions are also known in associated technical fields, for instance for electromagnetic shielding or else as flat conductor tracks for signal elements in membranes, but specifically in the case of flat heating elements there is a particular challenge with regard to the connection of the feeding electrodes to the resistance heating element on account of the current intensities that are required for them.

Published, non-prosecuted German patent application DE 10 2007 042 644 A1, corresponding to U.S. patent publication No. 2010/0206863, discloses a way of contacting electrodes in strip form to an electrically conductive, flexible flat structure, the fixing of the electrodes on the conductive, flat support taking place with the aid of stitches, which are intended to have the effect that the electrode is pressed against an electrically conductive coating of the support. This type of contacting has the disadvantage that the intimacy of the contact determines the contact resistance. If the stitching is not carried out securely enough or if the stitches come undone as a result of damage or thread fatigue, there is no longer adequate conductivity in the contact area and the heating effect of the flat structure is weakened or lost.

Particularly when the membrane is used for heating a seat in a car, i.e. under dynamic and climatic loads and over a relatively long time, such continuous loading may lead to functional changes in the operation of a seat heating element.

Furthermore, stitching-on has the disadvantage that a high pressure with a low contact resistance occurs locally under the stitch, i.e. under the wire that is respectively in contact (point bearing), whereas between stitches there is a lower pressure with a much higher contact resistance, since here the electrode is pressed less strongly against the conductive coating. This causes a lack of uniformity of the electrical contact resistance along the electrode, with the result that this also has effects on the homogeneity of the heating performance of the flat textile structure.

SUMMARY OF THE INVENTION

It is therefore the object of the invention to provide a heatable flat structure with improved contacting to the electrodes, it being possible for the flat structure to be used as a flexible, load-bearing flat heating element, in particular including in vehicle passenger compartments. The contacting is secure and durable and avoides damage or overheating of the contact areas even under high current loading, and reduces the contact resistance. Likewise disclosed are an interior lining part for a vehicle and a vehicle seat with such a heatable flat structure.

With the foregoing and other objects in view there is provided, in accordance with the invention a flexible flat structure. The flexible flat structure containing a flexible, flat resistance heating element formed from an electrically conductive material and at least two electrodes connected to the resistance heating element, being spaced apart from one another and intended for feeding electric current into the resistance heating element. Fasteners being either clips or clamps, for connecting the electrodes to the resistance heating element. The fasteners having clamping jaws acting against one another and engaging around a respective one of the electrodes and pressing the respective electrode onto the resistance heating element in a force-fitting manner or/and a form-fitting manner.

Provided here for connecting the electrodes to the resistance heating element are clips or clamps with clamping jaws acting against one another, which engage around the respective electrode—and of course also parts of the resistance heating element—and press the electrode onto the resistance heating element in a force-fitting and/or form-fitting manner. This may be achieved—for example in the case of force-fitting pressing—by resilient clamping or—in the case of form-fitting pressing—by snap-in clamping or intermeshing teeth.

The form of the flat structure according to the invention provides a very simple possible way of contacting without complicated additional operations such as the adhesive bonding or stitching attachment of electrodes. Equally, very flexible positioning of the electrodes is obtained, since the clamping allows production and assembly tolerances to be easily compensated. The positioning of the electrodes can also be corrected very easily.

In addition, by virtue of its robust clamping in comparison with other types of fastening, the type of contacting concerned is insensitive to dynamic or climatic loads, and of course also to aging effects. In addition, the form according to the invention ensures uniform contacting over the entire length of the electrode by way of the pressing pressure of the spring or clip.

The invention can be used wherever decorative interior materials are used (transportation, shipbuilding, furniture, etc.) and in the technical area of fashion (shoes, bags, clothing, etc.), that is to say also generally wherever textiles are coated.

Furthermore, with the composition according to the invention, stronger composite materials are also conceivable, for example for floor heating systems. Furthermore, the invention can be used wherever textile electrically conductive flat heating elements can be used, for example in living areas as wallpaper heating elements.

An advantageous development is that the resistance heating element is connected to a flat supporting material of nonconductive material. This allows the strength of the entire composite system, containing the flat resistance heating element of electrically conductive material and a resistant flat supporting element, to be adapted for many application purposes, for instance in the area of heavy-duty internal linings of vehicles, or for the floor heating systems mentioned, for surfacings for roads at risk of frost or areas of bridges, etc.

A further advantageous form that can be produced easily and particularly inexpensively by conventional machines is one in which the resistance heating element is formed as a braided or knitted fabric of metal wires or filaments.

A further advantageous form is one in which the resistance heating element is formed as a layer or membrane of electrically conductive material. In particular in the case of complicated shapes or whenever the integration of metal filaments is undesired, such coatings of conductive material as are known per se from the prior art are suitable, for instance as metal powder prepared as a suspension and applied in a polymer matrix or as powder containing particles with core-shell morphology, the shell being conductive. In this sense, a further advantageous form is therefore one in which the resistance heating element is formed as a layer of a conductive polymer, to be specific a polymer into which a sufficient quantity of conductive particles has been introduced.

A further advantageous form is one in which the resistance heating element is formed as a grid, for example as a grid-like coating of conductive polymer, since this increases the flexibility of the conductive coating, reduces the amount of conductive material and allows the routing of the resistance to be set precisely, and even differently in different regions, by the geometrical form of the grid bars.

A further advantageous form is one in which the electrode is formed as part of at least one clamping jaw. This simplifies the construction to the extent that the clamping jaws serve at the same time as an electrode and separately conducting rods, membranes or plates do not have to be used as electrodes.

A further advantageous form is one in which the electrode is formed as a strip electrode—i.e. is made wider than it is high, that is to say flat—and is pressed by the clamping jaws onto the resistance heating element. Such a separate electrode allows, for example, the conductive material of the electrode to be adapted exactly to the respective intended use with regard to conductivity and strength. For example, while a strip electrode containing a thin strip of aluminum is adequate in the case of the flat heating element in an astronaut suit, just a copper strip several centimeters wide may possibly be suitable for a textile wall heating element of a large surface area.

A further advantageous form is one in which the strip electrode is pressed on one side onto the resistance heating element. This provides a particularly easy-to-produce possible way of contacting the flat structure according to the invention.

A further advantageous form is one in which the resistance heating element contacts the strip electrode on more than one side, i.e. is "wrapped" around the strip electrode, and consequently the resistance heating element runs around the strip electrode and is pressed against the latter on both sides. This of course increases the available contact area and significantly reduces the contact resistance, so also allows the transfer of current of higher intensities.

After the flexible resistance heating element—possibly a flexible resistance heating element provided with a support—has been partially wrapped around it, the electrode is located between the two surfaces of the flexible resistance heating element, a clip pressing the two surfaces against the electrode.

At the same time—as a further advantageous form—layers may also additionally be introduced on one or both sides of the electrode to form a greater distance between the two surfaces of the flexible resistance heating element, at least one side of the electrode of course having to be of an electrically conductive design. This form with further inserted layers or strips has the additional advantage that, in the case of wrapping, the salient edge of the flexible resistance heating element and/or of the supporting material can be blunted by choosing the thickness of the electrode such that the radius at the salient edge is large enough for the conductivity of the flexible resistance heating element not to be damaged by an excessively sharp inflection. The same effect can also be achieved by the inserted electrode being lined or covered before it is pressed together with a conductive or nonconductive material.

This configuration continues in, and acts together with, a further advantageous form, which is one in which the electrode is of a multi-layered structure and, apart from a layer of conductive material, has at least one supporting or additional layer. At the same time, to improve the contacting, an additional electrically conductive strip of metal, with metal constituents, of conductive textiles, of carbon fibers, with carbon fiber constituents, or with conductive plastics, plastics formulations with conductive additives or adhesives, may be inserted such that this strip is pressed together with the electrode by the pressure of the spring or clip.

A further form which is advantageous because it can be produced particularly easily is one in which the clip or clamp is formed as a spring clip.

Furthermore, the clips may also be configured in the manner of a wide "crocodile clip", the width of the clips favorably corresponding to the desired contact length of the electrodes on the flexible conductive support. The contact width of the electrodes may be determined by the width of the pressure area of the clips. Consequently, apart from being made with smooth pressing surfaces, the clips or clamps are provided with specially formed surfaces of the clamping jaws. Preferred here, in a further advantageous form, are clamping jaws of which the contacting clamping areas have interlocking profiles, such as for instance jags, teeth, increased roughnesses or projections, or other jagged surfaces, which also additionally protect the clip from slipping.

The contacting by special clips may of course also be carried out in addition to other methods of contacting. For instance, electrodes which are, for example, stitched on or in, soldered on, crimped or adhesively attached (with a conductive adhesive), may be additionally contacted by the form according to the invention of the flexible resistance heating element.

A further advantageous form is one in which the electrodes are connected to the flat supporting material, for example the electrodes already being encapsulated in a central console of a vehicle. At the same time, electrodes may already be embedded in a support for the flexible electrically conductive resistance heating element, specially configured clips pressing the resistance heating element against these electrodes during assembly. Thus, these electrodes may, for example, be present in a support molded from plastic for a central console or side of a door, after which the support is then provided with the conductive resistance heating element and the contacting takes place by clips or springs in an area that is later not visible.

It is possible that contacting of an electrically conductive textile resistance heating element is followed by foam backing, insert molding or compression in-mold lamination of the same, so that the contacted area is then enclosed.

It is also possible in the case of the heatable flat structure according to the invention that more than two electrodes are connected to the conductive flexible resistance heating element.

Such heatable flat structures are particularly suitable as interior lining parts for a vehicle or else when used for a vehicle seat with seat heating.

Other features which are considered as characteristic for the invention are set forth in the appended claims.

Although the invention is illustrated and described herein as embodied in a flexible flat heating element, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
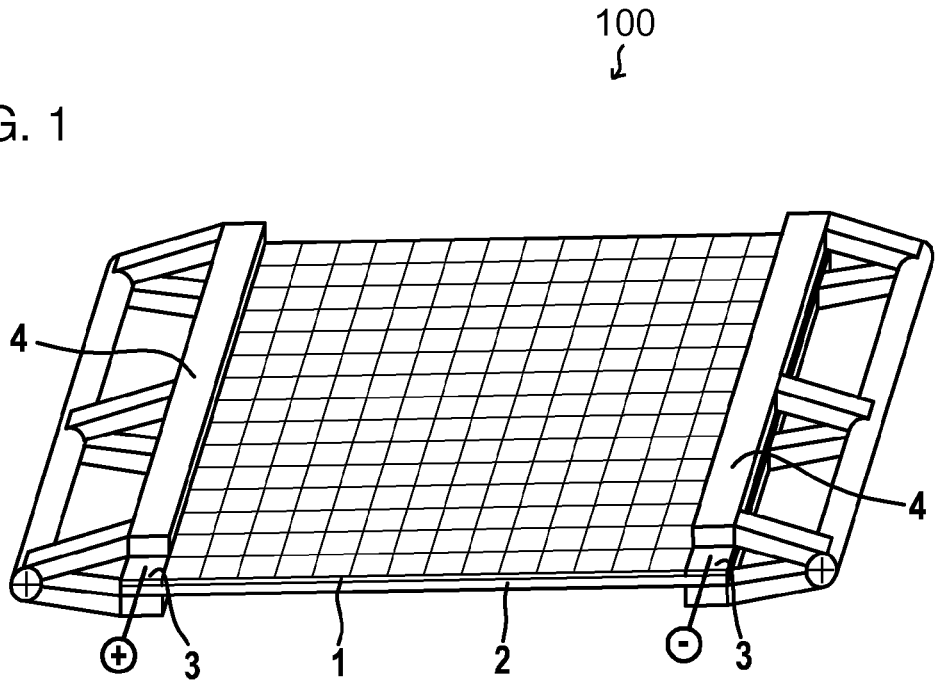
FIG. 1 is a diagrammatic, perspective view of a flat structure according to the invention.

Referring now to the figures of the drawing in detail and first, particularly, to FIG. 1 thereof, there is shown a flat structure 100 according to the invention, which contains a flexible, flat resistance heating element 1 of electrically conductive material and an electrically nonconductive flat support 2. The flexible, flat resistance heating element 1 is formed here as a grid-like coating of conductive polymer and is connected to two spaced-apart electrodes 3 for feeding in electric current. Provided for connecting the electrodes 3 to the resistance heating element 1 are clips 4 with clamping jaws acting against one another, which engage around the respective electrode 3 and the flat structure 100 and thereby press the electrode 3 onto the resistance heating element 1 in a force-fitting manner. The electrodes 3 are in this case configured as a flexible strip of an electrically conductive material and are fixed on the flat support 2 by the clips in such a way that at least one area of the electrode in strip form is in flat surface-area contact with the electrically conductive coating.

Figure 2:
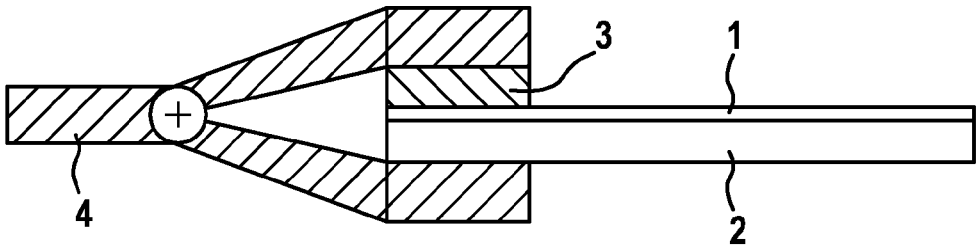
FIG. 2 is a diagrammatic, sectional view of a contacting of the flat structure according to the invention as shown in FIG. 1

FIG. 2 shows the contacting of the flat structure 100 as shown in FIG. 1 once again in section. Here again it can be clearly seen that, in the case of this configuration of the contacting, the electrode 3 is located between the conductive flexible resistance heating element 1 and the clip 4.

Figure 3:
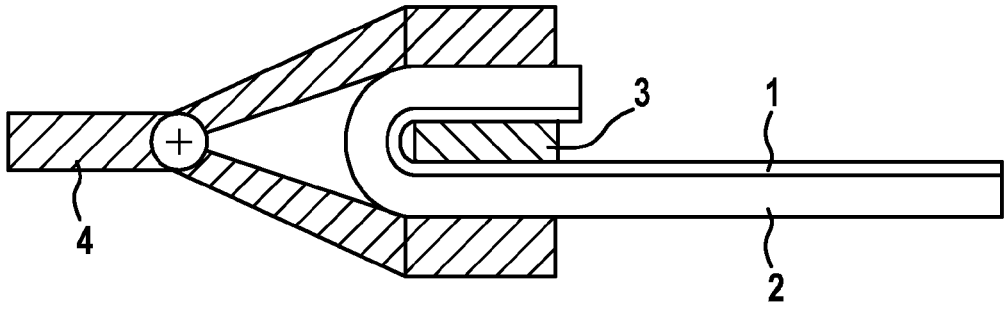
FIG. 3 is a diagrammatic, sectional view of a further configuration of the contacting of the flat structure according to the invention.

FIG. 3 shows another configuration of the contacting of the flat structure 100, in which the resistance heating element 1 and of course also the nonconductive flat support 2 are "wrapped" around the strip electrode, and consequently the strip electrode 3 contacts the resistance heating element 1 with its upper side and underside, i.e. on more than one side. Therefore, here the resistance heating element 1 wraps around the strip electrode 3 and is pressed against the strip electrode 3 on both sides by the clip 4.

The salient edge produced by the wrapping can be blunted by choosing the thickness of the electrode such that the radius at the salient edge is large enough for the conductivity of the flexible support not to be damaged by an excessively sharp inflection.

Figure 4:
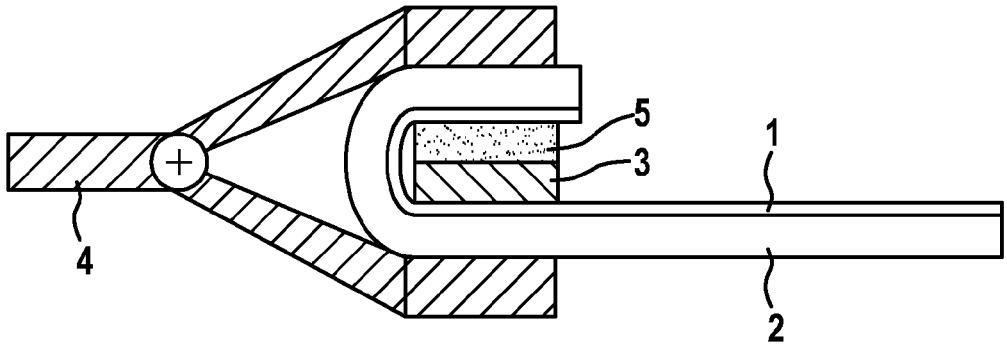
FIG. 4 is a diagrammatic, sectional view of another configuration of the contacting of the flat structure according to the invention with an additional supporting or reinforcing layer.

FIG. 4 shows a further configuration of the contacting of the flat structure 100, in which the electrode 3 is provided on its upper side with an additional supporting or reinforcing layer 5 of nonconductive material. As a result, the salient edge produced by the wrapping is further blunted and the electrode 3 is reinforced such that great clamping forces can be applied.

Of course, the electrode may also be lined on both sides, with the result that additional layers are introduced to form a greater distance between the two surfaces of the flexible flat structure 100 or of the conductive flexible resistance heating element 1, at least one side of the electrode 3 however having to be provided with layers of an electrically conductive design.

Layers may also be inserted to improve the contacting between the electrode 3 and the resistance heating element 1, for instance an additional electrically conductive strip of metal with metal constituents, of conductive textiles, of carbon fibers, with carbon fiber constituents, or with conductive plastics, plastics formulations with conductive additives.

Figure 5:
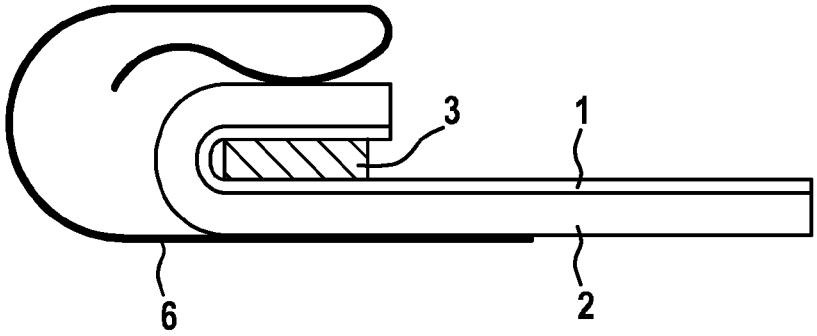
FIG. 5 is a diagrammatic, side view of a further configuration of the contacting of the flat structure according to the invention with a spring clip of plastic.

FIG. 5 shows a further configuration of the contacting of the flat structure 100, in which the clips are formed in one piece from plastic as spring clips 6. Such spring clips can be produced and assembled very easily, for example by continuous casting or extrusion processes, and may incidentally consist of any desired materials, that is to say also of copper or aluminum.

Figure 6:
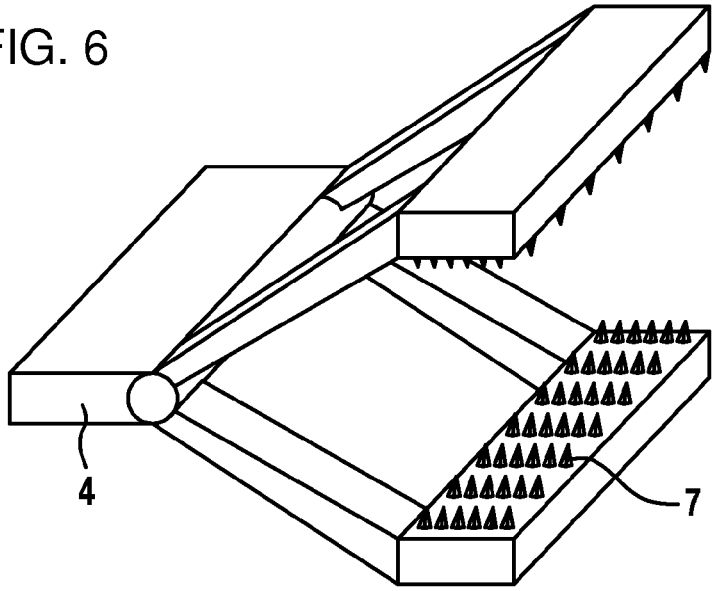
FIG. 6 is a diagrammatic, perspective view of another configuration of the contacting of the flat structure according to the invention in the form of a crocodile clip.

FIG. 6 shows a further configuration of the contacting of the flat structure 100, in which the clips 4 are formed such that their clamping areas of the clamping jaws have projecting teeth 7, and are consequently configured in the manner of a wide crocodile clip. The width of the clips corresponds to the desired contact length of the electrodes on the resistance heating element. The contact width of the electrodes may be determined by the width of the pressure area of the clips.

Of course, the clips as such may also be configured as an electrode, with the result that there is a conductive contact between at least one of the pressing areas of the clips and the conductive coating. In this case it is even possible to dispense with a separate strip electrode.

Figure 7:
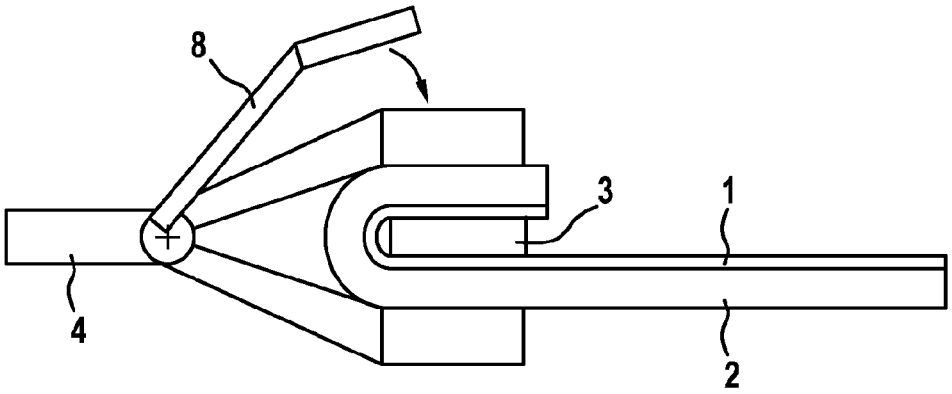
FIG. 7 is a diagrammatic, side view of another configuration of the contacting of the flat structure according to the invention with a closure clip and clip mechanism.

FIG. 7 shows a further configuration of the contacting of the flat structure 100, in which the clips 4 are formed such that their clamping areas are pressed by an additional closure clip 8. The additional closure clip 8 is provided with a clip mechanism, i.e. with a snap-in closure in the manner of a clip on suspenders.

Figure 8:
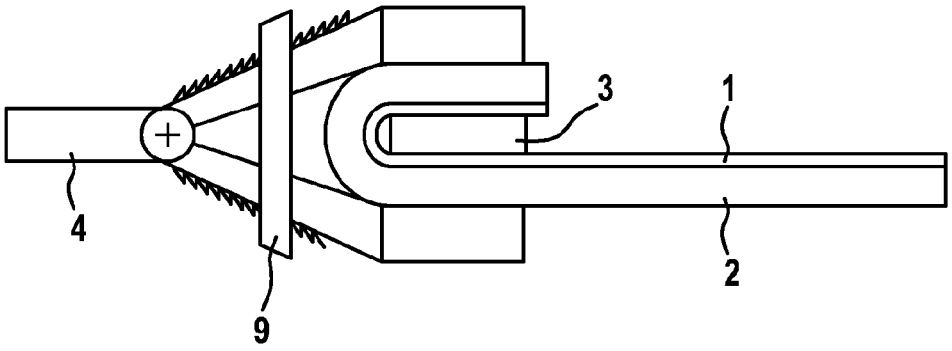
FIG. 8 is a diagrammatic, side view of another configuration of the contacting of the flat structure according to the invention with a closure ring and snap-in securement.

FIG. 8 shows a further configuration of the contacting of the flat structure 100, in which the clips 4 are formed such that their clamping areas are pressed by an additional closure clasp or ring 9, which is pushed onto the clips. The additional closure ring 9 is fixed and secured against slipping by intermeshing teeth or by snap-in means.

The invention claimed is:

1. A flexible flat structure, comprising:

a flexible, flat resistance heating element formed from an electrically conductive material;

at least two electrodes connected to said resistance heating element, being spaced apart from one another and intended for feeding electric current into said resistance heating element; and a hinged clip connecting said electrodes to said resistance heating element, said hinged clip having clamping jaws acting against one another and engaging around a respective one of said electrodes and resiliently pressing said respective electrode onto said resistance heating element in a force-fitting manner.

2. The flat structure according to claim 1, further comprising a flat supporting material formed from a nonconductive material connected to said resistance heating element.

3. The flat structure according to claim 2, wherein said electrodes are connected to said flat supporting material.

4. The flat structure according to claim 2, further comprising an additional support and said electrodes are connected to said additional support.

5. The flat structure according to claim 1, wherein said resistance heating element is formed as one of a braided fabric or a knitted fabric of one of metal wires or filaments.

6. The flat structure according to claim 1, wherein said resistance heating element is formed as a layer or membrane of said electrically conductive material.

7. The flat structure according to claim 6, wherein said resistance heating element is formed as said layer of a conductive polymer.

8. The flat structure according to claim 1, wherein said resistance heating element is formed as a grid.

9. The flat structure according to claim 1, wherein at least one of said electrodes is formed as part of at least one of said clamping jaws.

10. The flat structure according to claim 1, wherein at least one of said electrodes is formed as a strip electrode and is pressed by said clamping jaws onto said resistance heating element.

11. The flat structure according to claim 10, wherein said strip electrode is pressed on one side onto said resistance heating element.

12. The flat structure according to claim 10, wherein said resistance heating element contacts said strip electrode on more than one side and is pressed against said strip electrode.

13. The flat structure according to claim 10, wherein said electrode is of a multi-layered structure and, apart from a layer of conductive material, has at least one supporting or additional layer.

14. The flat structure according to claim 1, wherein said clamping jaws have contacting clamping areas with interlocking profiles selected from the group consisting of jags, teeth, increased roughnesses and projections.

15. The flat structure according to claim 1, further comprising an additional component pressing on said clamping jaws of said hinged clip; said additional component selected from the group consisting of an additional closure clip and a ring.

16. An interior lining part for a vehicle, comprising:

a flat structure containing:

a flexible, flat resistance heating element of electrically conductive material;

at least two electrodes connected to said resistance heating element, being spaced apart from one another and intended for feeding electric current into said resistance heating element; and a hinged clip connecting said electrodes to said resistance heating element, said hinged clip having clamping jaws acting against one another and engaging around a respective one of said electrodes and resiliently pressing said respective electrode onto said resistance heating element in a force-fitting manner.

17. The interior lining part according to claim 16, further comprising an additional component pressing on said clamping jaws of said hinged clip; said additional component selected from the group consisting of an additional closure clip and a ring.

18. A vehicle seat, comprising:

a flat structure containing:

a flexible, flat resistance heating element of electrically conductive material;

at least two electrodes connected to said resistance heating element, being spaced apart from one another and intended for feeding electric current into said resistance heating element; and a hinged clip connecting said electrodes to said resistance heating element, said hinged clip having clamping jaws acting against one another and engaging around a respective one of said electrodes and resiliently pressing said respective electrode onto said resistance heating element in at a force-fitting manner.

19. The vehicle seat according to claim 18, further comprising an additional component pressing on said clamping jaws of said hinged clip; said additional component selected from the group consisting of an additional closure clip and a ring.

* * * * *